US012006658B2

(12) United States Patent
Koci et al.

(10) Patent No.: US 12,006,658 B2
(45) Date of Patent: Jun. 11, 2024

(54) POWER SYSTEM FOR A MACHINE

(71) Applicant: Caterpillar Inc., Peoria, IL (US)

(72) Inventors: Chad Koci, Washington, IL (US); Jay R. Steffen, Washington, IL (US); Fang Guo, Dunlap, IL (US); Richard W. Kruiswyk, Dunlap, IL (US); Gaurav Vasudeva, Dunlap, IL (US); Robert Michael McDavid, Dunlap, IL (US); Timothy Adam Bazyn, Chilicothe, IL (US)

(73) Assignee: Caterpillar Inc., Peoria, IL (US)

( * ) Notice: Subject to any disclaimer, the term of this patent is extended or adjusted under 35 U.S.C. 154(b) by 425 days.

(21) Appl. No.: 17/301,651

(22) Filed: Apr. 9, 2021

(65) Prior Publication Data

US 2022/0325501 A1 Oct. 13, 2022

(51) Int. Cl.
*E02F 9/20* (2006.01)

(52) U.S. Cl.
CPC ..... *E02F 9/2075* (2013.01); *E02F 9/2091* (2013.01); *E02F 9/2095* (2013.01); *E02F 9/202* (2013.01)

(58) Field of Classification Search
CPC ..... E02F 9/2075; E02F 9/2091; E02F 9/2095; E02F 9/202; E02F 3/435
See application file for complete search history.

(56) References Cited

U.S. PATENT DOCUMENTS

| | | | | |
|---|---|---|---|---|
| 6,170,587 | B1 | 1/2001 | Bullock | |
| 9,718,343 | B2 | 8/2017 | Atkins et al. | |
| 2010/0044129 | A1* | 2/2010 | Kyle | B60L 7/18 180/65.21 |
| 2014/0013726 | A1* | 1/2014 | Yacoub | F01N 3/32 60/274 |
| 2016/0053782 | A1* | 2/2016 | Fliearman | F15B 21/14 60/413 |
| 2018/0162355 | A1* | 6/2018 | Colavincenzo | B60L 50/30 |
| 2018/0162374 | A1* | 6/2018 | Colavincenzo | B60K 6/448 |

FOREIGN PATENT DOCUMENTS

WO 2014/041326 A1 3/2014

OTHER PUBLICATIONS

Hayes et al, R.J. Design and Testing of a Flywheel Battery for a Transit Bus, Google Scholar, SAE Transactions, Journal of Passengers Cars, vol. 108, Sec. 6, 1999, pp. 2199-2207. (Year: 1999).*

(Continued)

*Primary Examiner* — Russell Frejd
(74) *Attorney, Agent, or Firm* — Harrity & Harrity, LLP

(57) ABSTRACT

A power system may include a high-speed flywheel connected to an engine of a machine; a battery; a motor-generator unit (MGU) connected to the engine and the battery; and a turbocharger connected to the engine. One or more of the high-speed flywheel, the battery and the MGU, or the turbocharger may be configured to provide supplemental power to power provided by the engine to operate the machine, or provide replacement power when no power is provided by the engine to operate the machine.

20 Claims, 11 Drawing Sheets

(56) References Cited

OTHER PUBLICATIONS

Kolmanovsky et al, I. Improving Turbocharged Diesel Engine Operation with Turbo Power Assist System, Google Scholar, Proceedings of the 1999 IEEE International Conference on Control Applications, 1999, pp. 454-459. (Year: 1999).*

Wang et al, C. Application of Flywheel System in Series Hybrid Transit Bus, Google Scholar, 2009 IEEE Vehicle Power and Propulsion Conference, pp. 1529-1534. (Year: 2009).*

Koci et al., "A Hybrid Heavy-Duty Diesel Power System for Off-Road Applications—Concept Definition," Caterpillar Inc./R-Flow Ltd./Volt Management Corp., 2021-01-0449, Published by SAE International on Apr. 6, 2021, 18 pages.

* cited by examiner

POWER SYSTEM FOR A MACHINE

STATEMENT OF GOVERNMENT INTEREST

This invention was made with government support under contract DE-EE0008476 awarded by the DOE. The Government has certain rights in this invention.

GOVERNMENT RIGHTS

This invention was made with government support under Award #: DE-EE0008476 awarded by the U.S. Department of Energy Office of Energy Efficiency & Renewable Energy. The government has certain rights in the invention.

TECHNICAL FIELD

The present disclosure relates generally to providing power to a machine and, for example, to a power system that provides power to a machine.

BACKGROUND

Off-road machines (e.g., large wheel loaders, excavators, and/or articulated trucks) are currently powered by diesel engines. Off-road durability and transient response requirements require powering the off-road machines using engines that are larger than desired that are operating at a partial load. Using such engines (e.g., full sized diesel engines) in this manner is inefficient. Additionally, the off-road machines perform off-road tasks that reduce the durability of the off-road machines.

Smaller diesel engines may be considered for improving fuel efficiency. As an example, smaller diesel engines may operate at a higher load than full sized diesel engines and at more efficient conditions than full sized diesel engines. However, smaller diesel engines do not have the capability to adequately respond to transient loads. For example, smaller diesel engines do not provide sufficient power, in a timely manner, for a sudden power requirement associated with a sudden acceleration, associated with a sudden movement of an implement to move material, among other examples.

U.S. Pat. No. 6,170,587 (the '587 patent) discloses a hybrid propulsion system for use in road vehicle operations, where the hybrid propulsion system includes a power splitting mechanical transmission, suitably a three shaft epicyclic gearbox, for coupling to a tail-shaft of the vehicle; a first drive unit arranged for regenerative operation and coupled to the power splitting mechanical transmission; and a second drive unit arranged for regenerative operation and coupled, independently of the first drive unit, to the power splitting mechanical transmission. The '587 patent further discloses that the hybrid propulsion system further includes a non-regenerative third drive unit for coupling, in parallel to the power splitting mechanical transmission, to the tail-shaft; and a propulsion control system for coordinating operation of the drive units in accordance with a plurality of predetermined modes corresponding to a drive cycle of the vehicle.

The '587 does not disclose that the hybrid propulsion system is for use in off-road machines, that the hybrid propulsion system includes a diesel engine, or that the hybrid propulsion system can adequately respond to transient loads of off-road machines.

The power system of the present disclosure solves one or more of the problems set forth above and/or other problems in the art.

SUMMARY

A power system includes a high-speed flywheel connected to an engine of a machine; a battery; a motor-generator unit (MGU) connected to the engine and the battery; and a turbocharger connected to the engine, wherein one or more of the high-speed flywheel, the battery and the MGU, or the turbocharger is configured to provide: supplemental power to power provided by the engine to operate the machine, or replacement power when no power is provided by the engine to operate the machine.

A work machine includes an engine; a high-speed flywheel connected to the engine; a battery; a motor-generator unit (MGU) connected to the engine and the battery; and a turbocharger connected to the engine, wherein one or more of the high-speed flywheel, the battery and the MGU, or the turbocharger is configured to provide: supplemental power to power provided by the engine to operate the work machine, or replacement power when no power is provided by the engine to operate the work machine.

A method includes receiving, by a controller of a power system, a request to provide power to operate a machine, wherein the power system comprises a high-speed flywheel, a battery connected to a motor-generator unit (MGU), and a turbocharger; determining, by the controller and based on the request, that one or more of the high-speed flywheel, the battery and the MGU, or the turbocharger are to provide the power; and causing, by the controller, the one or more of the high-speed flywheel, the battery and the MGU, or the turbocharger to provide the power as: supplemental power to power provided by an engine of the machine to operate the machine, or replacement power when no power is provided by the engine to operate the machine.

DETAILED DESCRIPTION

This disclosure relates to a power system for off-road machines such as large wheel loaders, excavators, articulated trucks, among other examples. The power system includes a high-speed flywheel connected an engine, a battery, a motor-generator unit connected to the engine and the battery, and a turbocharger connected to the engine. The engine may be a reduced size engine (e.g., reduced with respect to full sized diesel engines currently used in off-road machines). For example, the engine may be a 13 liter engine, which may be reduced from full sized diesel engines that are 18 liter engines.

The engine may provide improved fuel efficiency (with respect to the full sized diesel engines) due to the size of the engine. The power system may enable the engine to shut down when the machine is idle (thereby further improving fuel efficiency) and may provide replacement power to an air conditioning system and/or an electrical system of an operator cabin of the machine when the engine is shut down. The replacement power may refer to power replacing the power that would have otherwise been provided by the engine. The power system may provide supplemental power to power provided by the engine. Accordingly, the power system (in conjunction with the engine) may provide sufficient power, in a timely manner, as a response to a transient load of the machine. The supplemental power may refer to power that supplements the power provided by the engine (e.g., to meet or match power provided by full sized diesel engines).

The power system may provide improved energy recovery (with respect to the full sized diesel engines) via the high-speed flywheel, the battery, and the turbocharger. Accordingly, the power system may provide improved fuel efficiency with respect to the full sized diesel engines, may enable the engine to provide power that is similar or substantially similar to power provided by the full sized diesel engines, may provide improved energy recovery with respect to the full sized diesel engines, among other examples of advantages over the full sized diesel engines.

The term "machine" may refer to a machine that performs an operation associated with an industry such as, for example, mining, construction, farming, transportation, or another industry. Moreover, one or more implements may be connected to the machine. As an example, a machine may include a construction vehicle, a work vehicle, or a similar vehicle associated with the industries described above.

Figure 1:
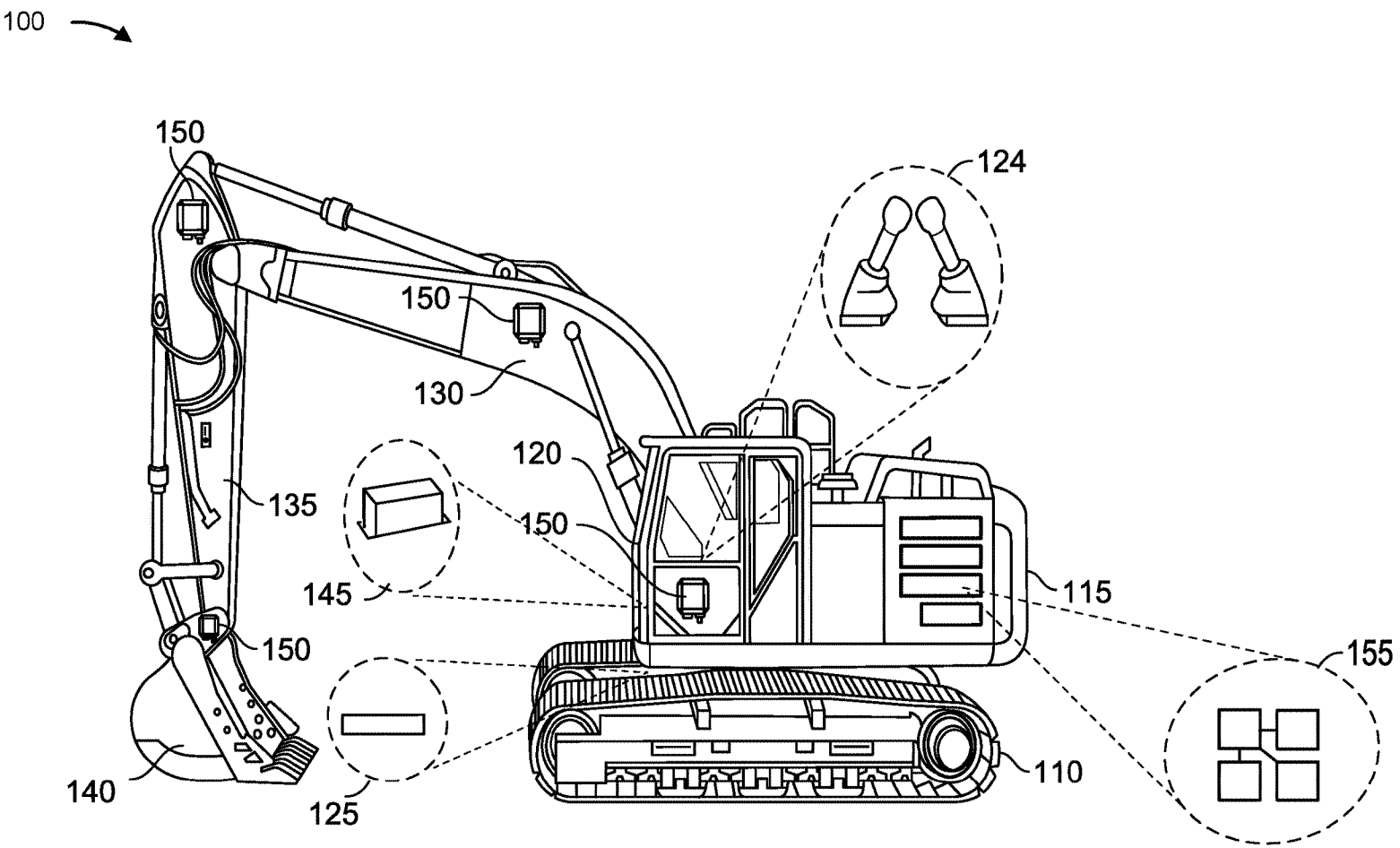
FIG. 1 is a diagram of an example machine described herein.

FIG. 1 is a diagram of an example machine 100 described herein. As shown in FIG. 1, machine 100 is embodied as an off-road machine, such as an excavator. Alternatively, the machine 100 may be another type of machine, such as a large wheel loader, an articulated truck, a dozer, a cold planner, among other examples.

As shown in FIG. 1, machine 100 includes ground engaging members 110, a machine body 115, an operator cabin 120, and a swivel element 125. Ground engaging members 110 may include tracks (as shown in FIG. 1), wheels, rollers, and/or the like, for propelling machine 100. Ground engaging members 110 are mounted on machine body 115 and are driven by one or more engines and drive trains (not shown). Machine body 115 is mounted on a rotating frame (not shown). Operator cabin 120 is supported by machine body 115 and the rotating frame. Operator cabin 120 includes an integrated display (not shown) and operator controls 124, such as, for example, integrated joystick. Operator controls 124 may include one or more input components.

For an autonomous machine, operator controls 124 may not be designed for use by an operator and, rather, may be designed to operate independently from an operator. In this case, for example, operator controls 124 may include one or more input components that provide an input signal for use by another component without any operator input. Swivel element 125 may include one or more components that enable the rotating frame (and machine body 115) to rotate (or swivel). For example, swivel element 125 may enable the rotating frame (and machine body 115) to rotate (or swivel) with respect to ground engaging members 110.

As shown in FIG. 1, machine 100 includes a boom 130, a stick 135, and a machine work tool 140. Boom 130 is pivotally mounted at a proximal end of machine body 115, and is articulated relative to machine body 115 by one or more fluid actuation cylinders (e.g., hydraulic or pneumatic cylinders), electric motors, and/or other electro-mechanical components. Stick 135 is pivotally mounted at a distal end of boom 130 and is articulated relative to boom 130 by the one or more fluid actuation cylinders, electric motors, and/or other electro-mechanical components. Machine work tool 140 is mounted at a distal end of stick 135 and may be articulated relative to stick 135 by the one or more fluid actuation cylinders, electric motors, and/or other electro-mechanical components. Machine work tool 140 may be a bucket (as shown in FIG. 1) or another type of tool that may be mounted on stick 135.

As shown in FIG. 1, machine 100 includes a controller 145 (e.g., an electronic control module (ECM)), one or more inertial measurement units (IMUs) 150 (referred to herein individually as "IMU 150," and collectively referred to as "IMUs 150"), and a power system 155. Controller 145 may control and/or monitor operations of machine 100. For example, controller 145 may control and/or monitor the operations of machine 100 based on signals from operator controls 124, signals from IMUs 150, and/or signals from power system 155.

As shown in FIG. 1, IMUs 150 are installed at different positions on components or portions of machine 100, such as, for example, on machine body 115, boom 130, stick 135, and machine work tool 140. An IMU 150 includes one or more devices that are capable of receiving, generating, storing, processing, and/or providing signals indicating a position and orientation of a component, of machine 100, on which the IMU 150 is installed. For example, IMU 150 may include one or more accelerometers and/or one or more gyroscopes. The one or more accelerometers and/or the one or more gyroscopes generate and provide signals that can be used to determine a position and orientation of the IMU 150 relative to a frame of reference and, accordingly, a position and orientation of the component. While the example discussed herein refers to IMUs 150, the present disclosure is applicable to using one or more other types of sensor devices that may be used to determine a position and orientation of a component of machine 100.

Power system 155 may include one or more devices that are configured to provide power to operate the machine and/or recover (or store) energy generated during an operation of machine 100, as explained in more detail below. In some examples, power system 155 may be controlled by controller 145. For example, controller 145 may provide one or more signals to cause power system 155 to provide supplemental power to power provided by an engine of machine 100 to operate machine 100 and/or cause power system 155 to recover energy during an operation of machine 100 (e.g., during a braking operation), as explained in more detail below.

As indicated above, FIG. 1 is provided as an example. Other examples may differ from what was described in connection with FIG. 1.

Figure 2:
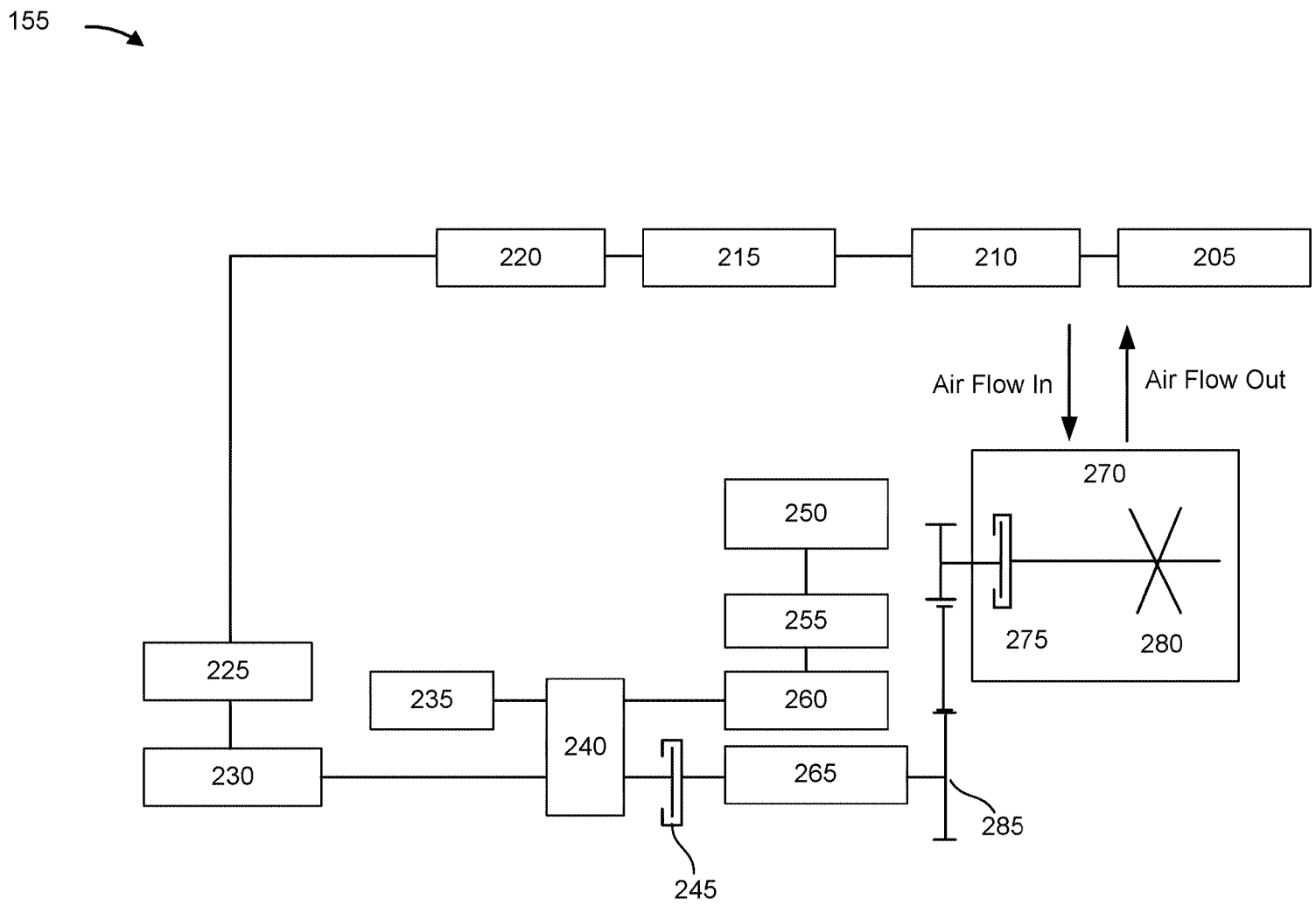
FIGS. 2-10 are diagrams of example power systems described herein.

FIG. 2 is a diagram of an example power system 155 described herein. As shown in FIG. 2, power system 155 includes a high-speed flywheel 205, a gear ratio device 210, a motor-generator unit (MGU) 215 (hereinafter "flywheel MGU 215"), a first inverter 220, a second inverter 225, an MGU 230 (hereinafter "engine MGU 230"), an air conditioning (A/C) system 235, a battery 250, a third inverter 255, an MGU 260 (hereinafter "battery MGU 260"), an engine 265, and a turbocharger 270. Engine 265 may include a hybrid front-end accessory drive (FEAD) 240, a disconnect clutch 245, and a gear train 285.

High-speed flywheel 205 may include a device that is configured to recover (or store) energy generated by engine 265 during an operation of machine 100. For example, high-speed flywheel 205 may be configured to recover energy (e.g., excess energy) generated during a braking operation of engine 265 (e.g., compression braking engine operation). Additionally, high-speed flywheel 205 may be configured to provide power to operate machine 100. For example, high-speed flywheel 205 may be configured to provide supplemental power to power provided by engine 265 to operate machine 100 and configured to provide replacement power when no power is provided by engine 265 to operate machine 100 (e.g., when engine 265 is shut down).

In some examples, high-speed flywheel 205 may provide supplemental power as a response to a transient load (e.g., a sudden power requirement) associated with an operation of machine 100, such as a sudden acceleration of machine 100, a sudden movement of an implement of machine 100 to move material, among other examples. The power provided by high-speed flywheel 205 may be based on the energy stored by high-speed flywheel 205. In some examples, high-speed flywheel 205 may provide replacement power (e.g., when engine 265 is shut down) to operate one or more components of machine 100, such as to operate A/C system 235, to operate an alternator, to operate an electrical system of operator cabin 120, among other examples. For instance, high-speed flywheel 205 may provide replacement power to operate A/C system 235 via FEAD 240. By providing power in this manner, high-speed flywheel 205 may reduce fuel consumption of engine 265. As shown in FIG. 2, high-speed flywheel 205 may be connected to gear ratio device 210.

Gear ratio device 210 device may include a planetary gear, a spur gear, among other examples. As shown in FIG. 2, gear ratio device 210 may be connected to flywheel MGU 215. Flywheel MGU 215 may be configured to drive high-speed flywheel 205 (e.g., configured to cause a rotation of high-speed flywheel 205). As an example, flywheel MGU 215 may convert alternating current (AC) power (e.g., provided by first inverter 220 based on energy generated based on an operation of engine 265) to a rotational energy to cause a rotation of high-speed flywheel 205, thereby causing high-speed flywheel 205 to store energy (e.g., the energy generated by engine 265).

In some examples, a rotational speed range of flywheel MGU 215 may differ from a rotational speed range of high-speed flywheel 205. For instance, the rotational speed range of flywheel MGU 215 may be less than the rotational speed range of high-speed flywheel 205. In this regard, gear ratio device 210 may be configured to convert a rotational speed of flywheel MGU 215 to a rotational speed of high-speed flywheel 205 to enable proper operation of high-speed flywheel 205 (e.g., to enable an appropriate rotational speed of high-speed flywheel 205 that causes high-speed flywheel 205 to store energy).

As an example, if the rotational speed of flywheel MGU 215 is 5,000 revolutions per minute (RPM) and high-speed flywheel 205 requires 20,000 RPM to operate properly, gear ratio device 210 may convert the 5,000 RPM (of flywheel MGU 215) to the 20,000 RPM required for the proper operation of high-speed flywheel 205. In some implementations, flywheel MGU 215 may be connected to high-speed flywheel 205 (without being connected to gear ratio device 210) if flywheel MGU 215 is capable of producing the rotational speed required by high-speed flywheel 205. Flywheel MGU 215 may be configured to obtain energy stored by high-speed flywheel 205 and convert the energy into power (e.g., AC power) that is provided to operate machine 100. Flywheel MGU 215 may obtain the energy by decreasing a rotational speed of high-speed flywheel 205 (e.g., based on a signal provided by controller 145). The power may include the supplemental power or the replacement power discussed above. As shown in FIG. 2, flywheel MGU 215 may be connected to first inverter 220.

First inverter 220 may be configured to convert the AC power (provided by flywheel MGU 215 based on energy from high-speed flywheel 205) to direct current (DC) power provided to second inverter 225. Additionally, first inverter 220 may be configured to convert the DC power (provided by second inverter 225) to AC power provided to flywheel MGU 215. Second inverter 225 may be configured to convert the DC power (provided by first inverter 220) to AC power provided to engine MGU 230. Additionally, second inverter 225 may be configured to convert AC power (provided by engine MGU 230 based on an operation of engine 265) to the DC power provided to first inverter 220. In some examples, first inverter 220 and second inverter 225 may be connected to a DC bus. As an example, the DC bus may be a 700-volt DC bus, although other types of buses may be used in practice. As shown in FIG. 2, second inverter 225 may be connected to engine MGU 230.

Engine MGU 230 may operate in a manner similar to the manner described above in connection with flywheel MGU 215. Engine MGU 230 may be configured to convert AC power (e.g., generated based on energy from high-speed flywheel 205 and provided by second inverter 225) to mechanical energy that is supplemental power to power provided engine 265 or is replacement power when no power is provided by engine 265 to operate machine 100. The supplemental power may enable engine 265 to provide power similar to or substantially similar to power provided by full sized diesel engines. Engine MGU 230 may be configured to convert mechanical energy, generated based on an operation of engine 265 (e.g., excess energy generated based on a braking operation of engine 265), to AC power that is provided to flywheel MGU 215 via second inverter 225 and first inverter 220. The AC power may be converted into energy that is stored by high-speed flywheel 205, as explained above.

Engine MGU 230 may be configured to operate in accordance with an engine speed of engine 265 while flywheel MGU 215 may be configured to operate in accordance with a rotational speed of high-speed flywheel 205. By configuring engine MGU 230 and flywheel MGU 215 to operate in this manner, power system 155 may enable independent control of engine 265 and high-speed flywheel 205, thereby enabling complete high-speed flywheel 205-to-engine decoupling. As shown in FIG. 2, engine MGU 230 may be connected to FEAD 240 to enable the replacement power (from high-speed flywheel 205) to be provided, as described above.

A/C system 235 may include an A/C unit. A/C system 235 may be used for cooling operator cabin 120. As shown in FIG. 2, A/C system 235 may be connected to FEAD 240. As shown in FIG. 2, FEAD 240 may be connected to disconnect clutch 245. Disconnect clutch 245 may enable engine 265 to shut down (e.g., when machine 100 is idle and is not performing an operation). FEAD 240 and disconnect clutch 245 are discussed below in connection with engine 265.

As shown in FIG. 2, battery 250 may be connected to FEAD 240 via third inverter 255 and battery MGU 260. Battery 250 may be configured to provide power (e.g., DC power) to operate machine 100. For example, battery 250 may be configured to provide supplemental power to power provided by engine 265 to operate machine 100, as described above. Additionally, battery 250 may be configured to provide replacement power when no power is provided by engine 265 to operate the machine (e.g., when engine 265 is shut down), as described above. By providing power in this manner, battery 250 may reduce fuel consumption of engine 265. Additionally, battery 250 may be configured to recover energy generated by engine 265 during an operation of machine 100. For example, battery 250 may be configured to be charged based on energy (e.g., excess energy) generated during a braking operation of engine 265. As an example, battery 250 may be a 48-volt battery, although other types of batteries may be used in practice.

As shown in FIG. 2, battery 250 may be connected to third inverter 255. Third inverter 255 may be configured to convert DC power (provided by battery 250) to AC power provided to battery MGU 260 and convert AC power (provided by battery MGU 260 based on an operation of engine 265) to DC power provided to battery 250 to charge battery 250. As shown in FIG. 2, third inverter 255 may be connected to battery MGU 260.

Battery MGU 260 may be configured to convert the AC power (e.g., provided by third inverter 255) to mechanical energy that is supplemental power to power provided by engine 265 or replacement power when no power is provided by engine 265 to operate the machine 100, in a manner similar to the manner described above. Battery MGU 260 may be configured to convert mechanical energy, generated based on an operation of engine 265 (e.g., excess energy generated based on a braking operation of engine 265), to AC power that is provided to third inverter 255. The AC power may be converted, by third inverter 255, to DC power and the DC power may be provided to battery 250 to charge battery 250.

In some examples, battery 250, third inverter 255, and battery MGU 260 may be connected via a DC bus. As an example, the DC bus may be a 48-volt DC bus and battery MGU 260 may be a 48-volt MGU, although other types of buses and MGUs may be used in practice. As shown in FIG. 2, battery MGU 260 may be connected to FEAD 240. Battery MGU 260 may be connected in this manner to enable the replacement power (from battery 250) to be provided, as described above.

Engine 265 may be configured to provide power to operate machine 100 (e.g., based on one or more signals from controller 145). Additionally, engine 265 may be configured to provide excess energy, generated during a braking operation of engine 265, to high-speed flywheel 205 and/or battery 250 (e.g., based on one or more signals from controller 145). In some instances, the excess energy may be provided via FEAD 240 to high-speed flywheel 205 and/or battery 250. High-speed flywheel 205 and/or battery 250 may recover the excess energy as explained above.

Additionally, engine 265 may be configured to provide excess energy, generated by an exhaust system of engine 265, to turbocharger 270. In some instances, the excess energy (provided to turbocharger 270) may be provided via gear train 285 to an engine crankshaft of engine 265. For example, the excess energy (e.g., excess exhaust energy) may be provided from the exhaust system (e.g., from an engine exhaust of engine 265) to turbocharger 270. The excess energy may be provided from turbocharger 270 to gear train 285 and back to the engine crankshaft. Engine 265 may include a diesel engine. For instance, a size of engine 265 may be smaller than a size of a full sized diesel engine that powers an off-road machine. FEAD 240 may receive power generated based on an operation of high-speed flywheel 205, an operation of battery 250 and battery MGU 260, and/or an operation of engine 265 and may provide the power to A/C system 235. In some implementations, turbocharger 270 may be connected to FEAD 240 instead of being connected to gear train 285. For example, turbocharger 270 may be driven off of FEAD 240.

Disconnect clutch 245 may enable engine 265 to shut down (e.g., when machine 100 is idle and is not performing an operation). As an example, when disconnect clutch 245 is engaged, engine 265 may shut down and enable machine 100 to conserve fuel. When engine 265 is shut down, one or more of high-speed flywheel 205 or battery 250 and battery MGU 260 may be configured to provide replacement power to A/C system 235 (e.g., via FEAD 240), provide power to an electrical system of operator cabin 120, among other examples. High-speed flywheel 205 or battery 250 and battery MGU 260 may be configured to provide power in this manner based on one or more signals from controller 145. In some examples, gear train 285 may include a power takeoff (PTO) and a crankshaft. In some instances, the PTO may be provided in a rear portion of engine 265.

Turbocharger 270 may be a mechanically driven turbocharger that includes a clutch 275 and a continuously variable transmission (CVT) 280. CVT 280 may enable a ratio, between a speed of turbocharger 270 and a speed of engine 265, to be varied (e.g., adjusted). Turbocharger 270 may be configured to recover energy from engine 265. For example, turbocharger 270 may be configured to recover excess energy generated by the exhaust system of engine 265 (e.g., generated by exhaust gasses of the exhaust system). The excess energy may be provided to turbocharger 270, thereby increasing the speed of turbocharger 270 (e.g., increasing a rotational speed of turbocharger 270). Turbocharger 270 may recover the excess energy by way of turbo-compounding. The excess energy (provided to turbocharger 270) may be provided via gear train 285 to the engine crankshaft.

Additionally, turbocharger 270 may be configured to provide power to operate machine 100. For example, turbocharger 270 may be configured to provide energy (e.g., the excess energy recovered from the exhaust system) as supplemental power to power provided by engine 265 to operate machine 100. In some examples, turbocharger 270 may provide the supplemental power as a response to a transient load associated with an operation of machine 100, such as a sudden acceleration of machine 100. As an example, turbocharger 270 may cause an increase of airflow to engine 265 as a response to the transient load. For example, turbocharger 270 may take power from gear train 285 to increase airflow. The increased airflow may enable more fuel and power to be made by engine 265 in a manner that is faster than a normal operation of engine 265, thereby meeting a transient response of a full sized diesel engine. By providing power in this manner, turbocharger 270 may reduce fuel consumption of engine 265.

As shown in FIG. 2, high-speed flywheel 205 may be connected to engine 265 via an electric drive configuration. For example, as shown in FIG. 2, high-speed flywheel 205 may be connected to engine 265 via flywheel MGU 215, first inverter 220, second inverter 225, and engine MGU 230. In some implementations, high-speed flywheel 205 may be connected to engine 265 via a multi-speed gear box. Alternatively, high-speed flywheel 205 may be connected to engine 265 via a hydrostatic transmission. For example, high-speed flywheel 205 may be connected to a hydraulic motor (e.g., via a gear ratio device), and the hydraulic motor may be connected to a hydraulic pump which may be connected to one or more valves. The hydraulic motor may be connected to engine 265 via a clutch and a gear ratio device.

High-speed flywheel 205, battery 250 and battery MGU 260, and turbocharger 270 may be independently connected to the crankshaft of engine 265. As explained herein, power system 155 may reduce fuel consumption of engine 265, may enable engine 265 to provide power in a manner similar to a larger diesel engine, and may provide energy recovery capabilities.

The number and arrangement of devices shown in FIG. 2 are provided as an example. In practice, there may be additional devices, fewer devices, different devices, or differently arranged devices than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of power system 155 may perform one or more functions described as being performed by another set of devices of power system 155.

Figure 3:
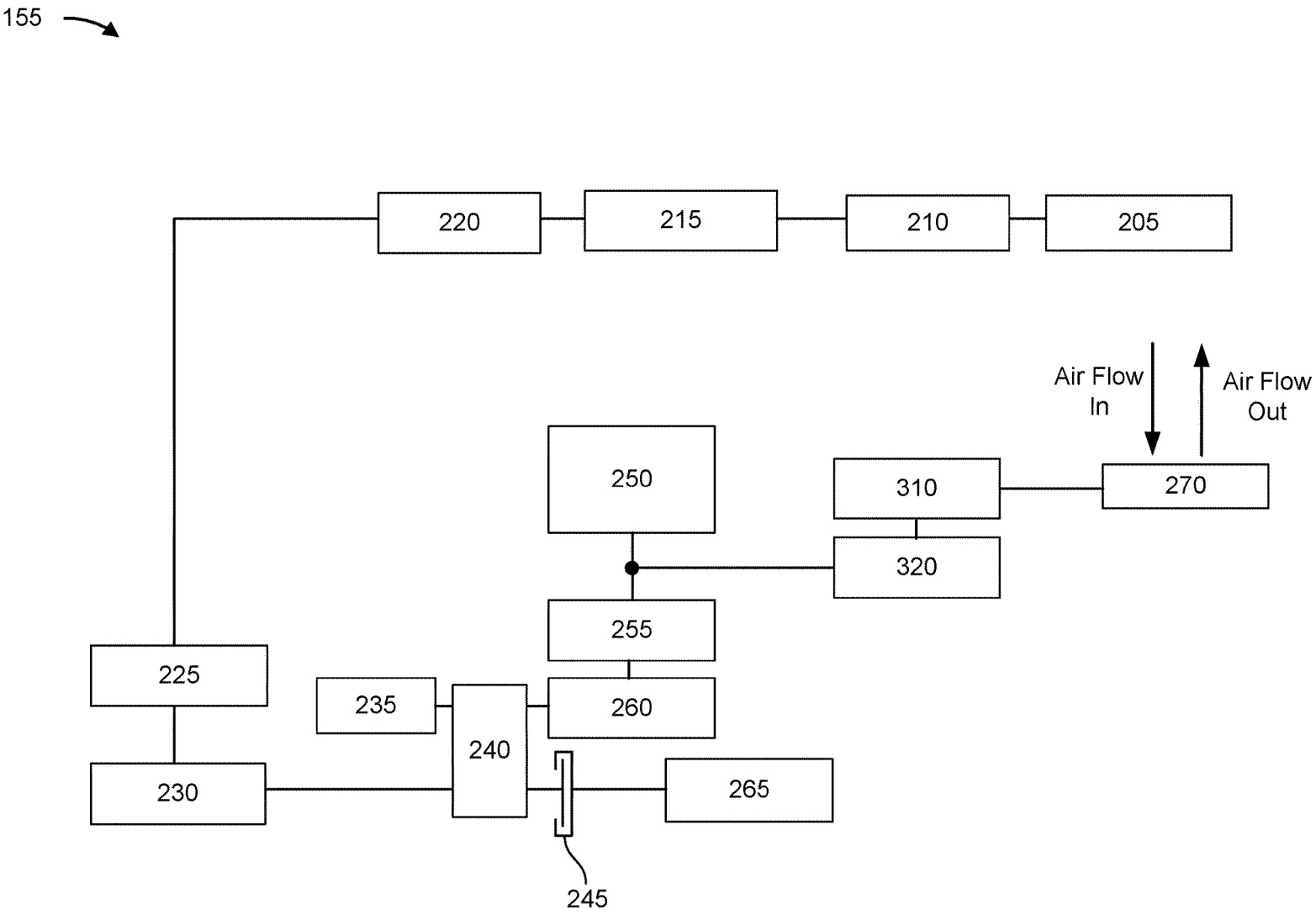

FIG. 3 is a diagram of an example power system 155 described herein. The elements of power system 155 have been described above with respect to FIG. 2. As shown in FIG. 3, turbocharger 270 may be connected to the DC bus (to which battery 250 is connected) via an electric drive configuration. In such instance, turbocharger 270 may be provided without clutch 275 and CVT 280. As shown in FIG. 3, turbocharger 270 may be connected to the DC bus via an MGU 310 and an inverter 320. MGU 310 may be configured and may operate in a manner similar to the manner described above in connection with battery MGU 260. Inverter 320 may be configured and may operate in a manner similar to the manner described above in connection with first inverter 220, second inverter 225, and/or third inverter 255. In some examples, turbocharger 270 in conjunction with battery 250 and battery MGU 260 (e.g., based on a signal from controller 145) may provide supplemental power to power provided by engine 265 to operate machine 100. In some examples, the example power system 155 described in FIG. 3 may provide improved ratio flexibility and improved packaging with respect to FIG. 2.

The number and arrangement of devices shown in FIG. 3 are provided as an example. In practice, there may be additional devices, fewer devices, different devices, or differently arranged devices than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of power system 155 may perform one or more functions described as being performed by another set of devices of power system 155.

Figure 4:
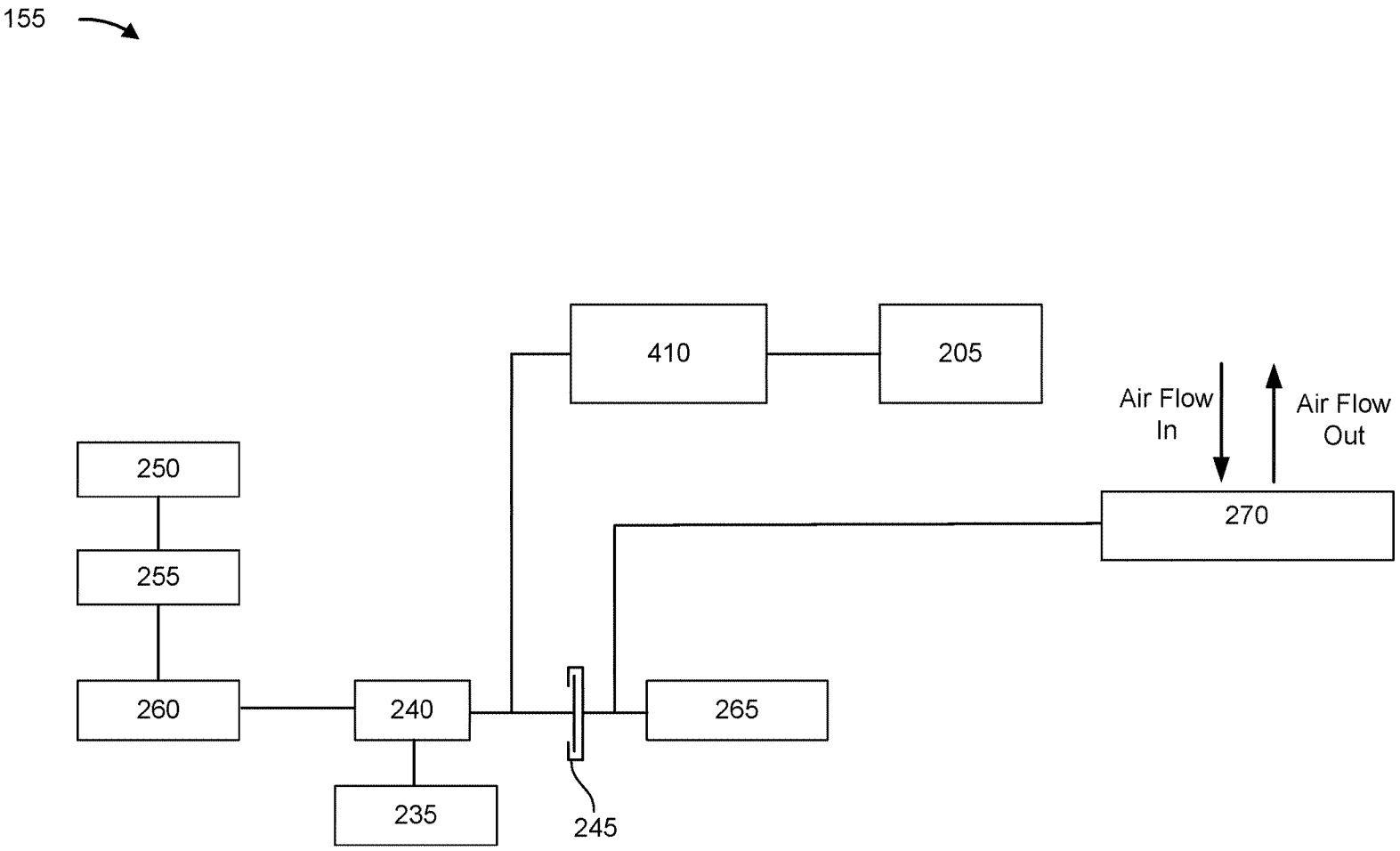

FIG. 4 is a diagram of an example power system 155 described herein. The elements of power system 155 have been described above with respect to FIG. 2. As shown in FIG. 4, high-speed flywheel 205 may be connected to engine 265 via a mechanical configuration (instead of the electric drive configuration described in FIG. 2). As shown in FIG. 3, high-speed flywheel 205 may be connected to engine 265 via a clutch and CVT 410 (e.g., a clutch and belt-type CVT). Clutch and CVT 410 may be connected to FEAD 240 and connected to disconnect clutch 245. Clutch and CVT 410 may be connected in this manner to enable the replacement power (from high-speed flywheel 205) to be provided, as described above. As shown in FIG. 4, turbocharger 270 may be connected to engine 265 (e.g., connected to the crankshaft of engine 265). Alternatively, turbocharger 270 may be connected to high-speed flywheel 205 (e.g., connected directly to high-speed flywheel 205). In some examples, the example power system 155 described in FIG. 4 may reduce total system cost and electrical system cost, as well as provide an integrated system packaged in physical proximity to engine 265.

The number and arrangement of devices shown in FIG. 4 are provided as an example. In practice, there may be additional devices, fewer devices, different devices, or differently arranged devices than those shown in FIG. 4. Furthermore, two or more devices shown in FIG. 4 may be implemented within a single device, or a single device shown in FIG. 4 may be implemented as multiple, distributed devices. Additionally, or alternatively, a set of devices (e.g., one or more devices) of power system 155 may perform one or more functions described as being performed by another set of devices of power system 155.

Figure 5:
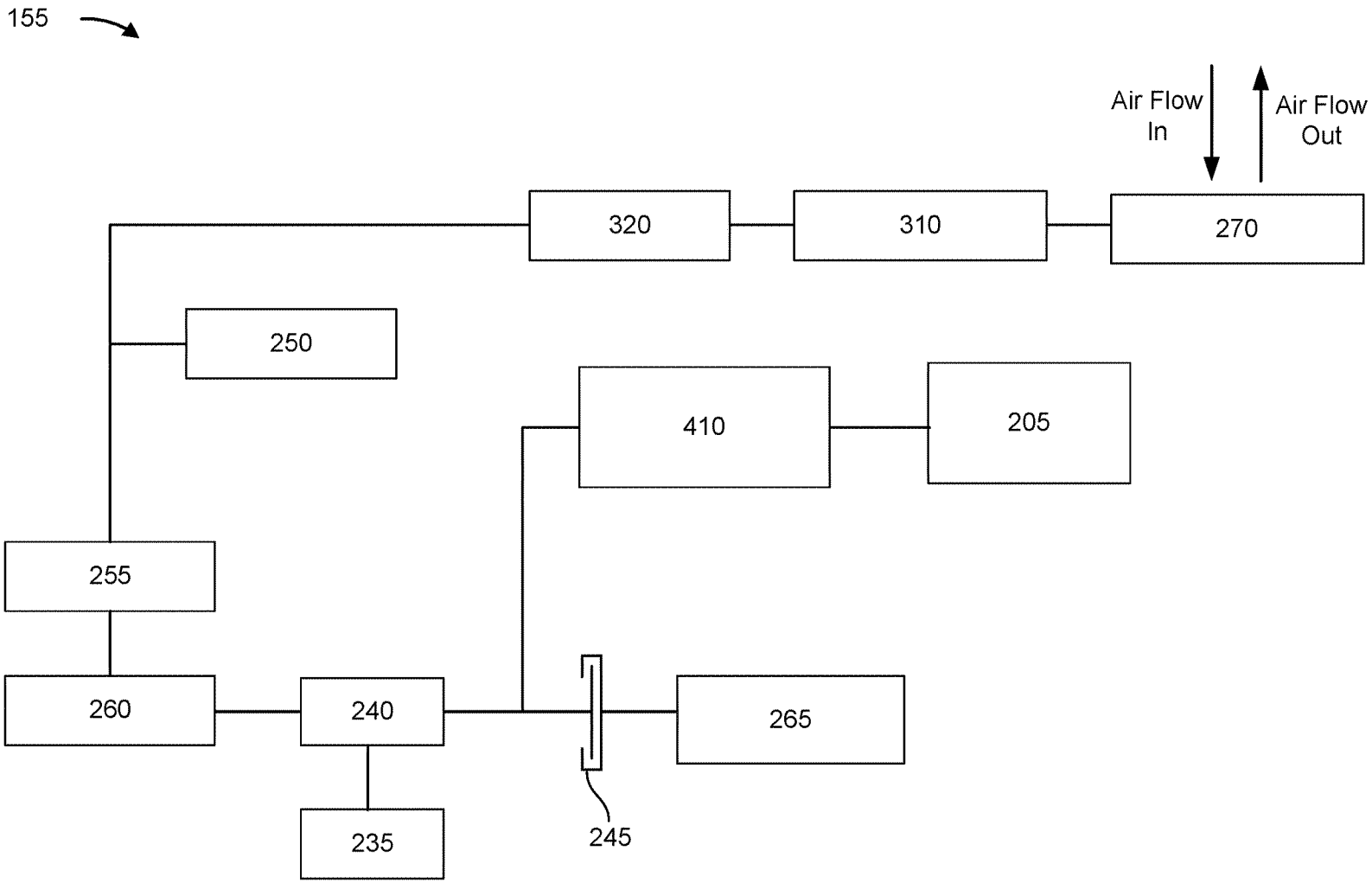

FIG. 5 is a diagram of an example power system 155 described herein. The elements of power system 155 have been described above with respect to FIGS. 2, 3, and 4. As shown in FIG. 5, high-speed flywheel 205 may be connected to engine 265 via a mechanical configuration, as described above in connection with FIG. 4. As shown in FIG. 5, turbocharger 270 may be connected to the DC bus (to which battery 250 is connected) via an electric drive configuration, as described above in connection with FIG. 3. In some examples, turbocharger 270, MGU 310, and inverter 320 may be integrated into an electric turbocharger. The electric turbocharger may be a 48-volt electric turbocharger, although other types of electric turbochargers may be used in practice. The different arrangements of devices might be used for different machines (different models, different machine types, etc.), for different types of engines, for different types of planned uses of a machine, among other examples. In some examples, the example power system 155 described in FIG. 5 may provide improved ratio flexibility and improved packaging with respect to the example power system 155 described in FIG. 2. Additionally, the example power system 155 described in FIG. 5 may simplify the example power system 115 described in FIG. 3 by separating high-speed flywheel 205 from clutch and CVT 410. This separation may provide turbocharger 270 and engine MGU 230 on a common electrical system because turbocharger 270 and engine MGU 230 have a same power range.

The number and arrangement of devices shown in FIG. 5 are provided as an example. In practice, there may be additional devices, fewer devices, different devices, or differently arranged devices than those shown in FIG. 5. Furthermore, two or more devices shown in FIG. 5 may be implemented within a single device, or a single device shown in FIG. 5 may be implemented as multiple, distributed devices. Additionally, or alternatively, a set of devices (e.g., one or more devices) of power system 155 may perform one or more functions described as being performed by another set of devices of power system 155.

Figure 6:
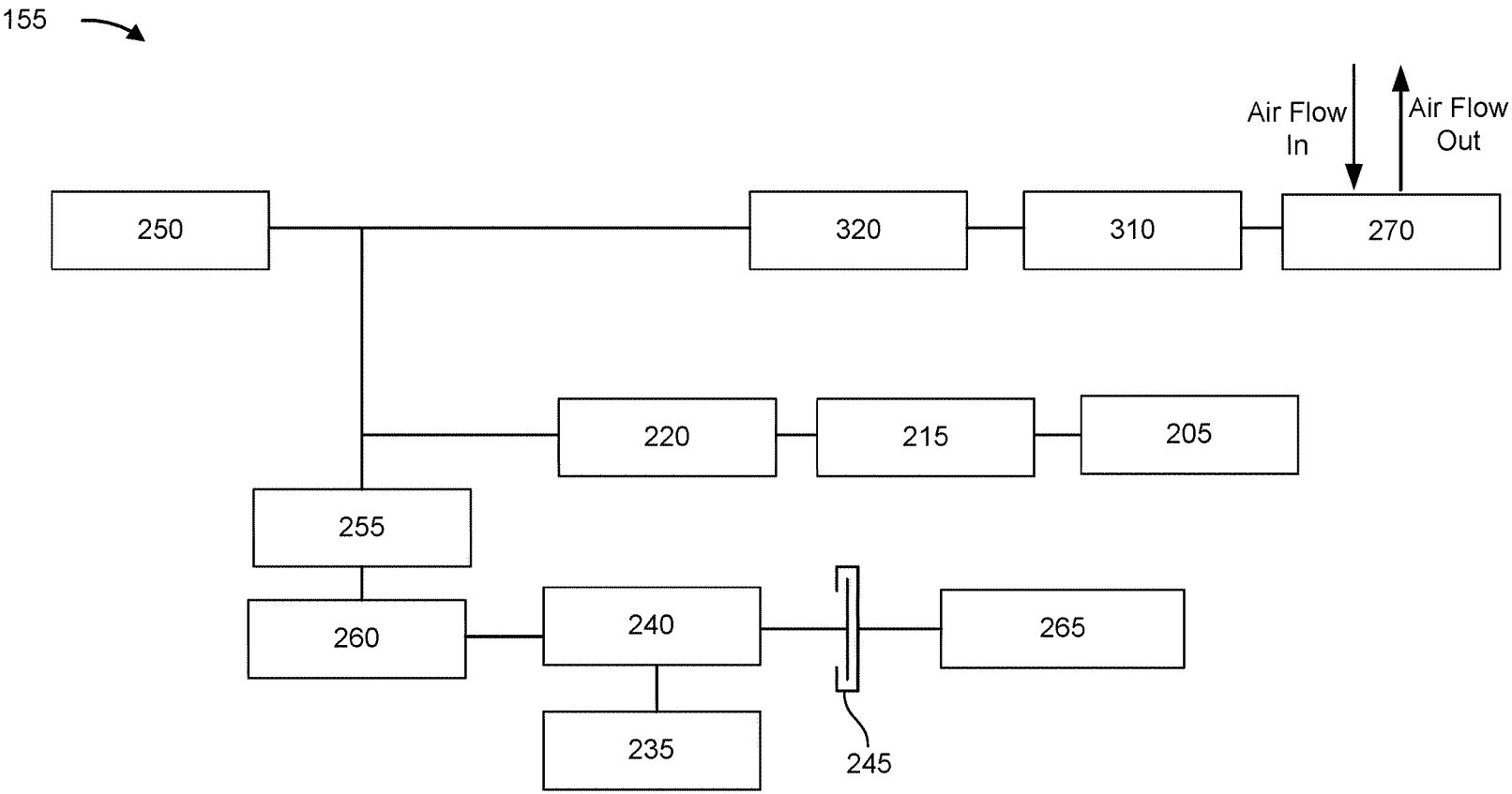

FIG. 6 is a diagram of an example power system 155 described herein. The elements of power system 155 have been described above with respect to FIGS. 2 and 3. As shown in FIG. 5, high-speed flywheel 205 may be connected to the DC bus (to which battery 250 is connected) via an electric drive configuration. For example, high-speed flywheel 205 may be connected to flywheel MGU 215, flywheel MGU 215 may be connected to first inverter 220, and first inverter 220 may be connected to the DC bus. As shown in FIG. 6, turbocharger 270 may be connected to the DC bus (to which battery 250 is connected) via an electric drive configuration, as described above in connection with FIG. 3. In some implementations, the power system 155 described in FIG. 6 provides commonality and modularity for all electrical configurations. Additionally, the power system 115 may enable adaptation for different engines and different system power level.

The number and arrangement of devices shown in FIG. 6 are provided as an example. In practice, there may be additional devices, fewer devices, different devices, or differently arranged devices than those shown in FIG. 6. Furthermore, two or more devices shown in FIG. 6 may be implemented within a single device, or a single device shown in FIG. 6 may be implemented as multiple, distributed devices. Additionally, or alternatively, a set of devices (e.g., one or more devices) of power system 155 may perform one or more functions described as being performed by another set of devices of power system 155.

Figure 7:
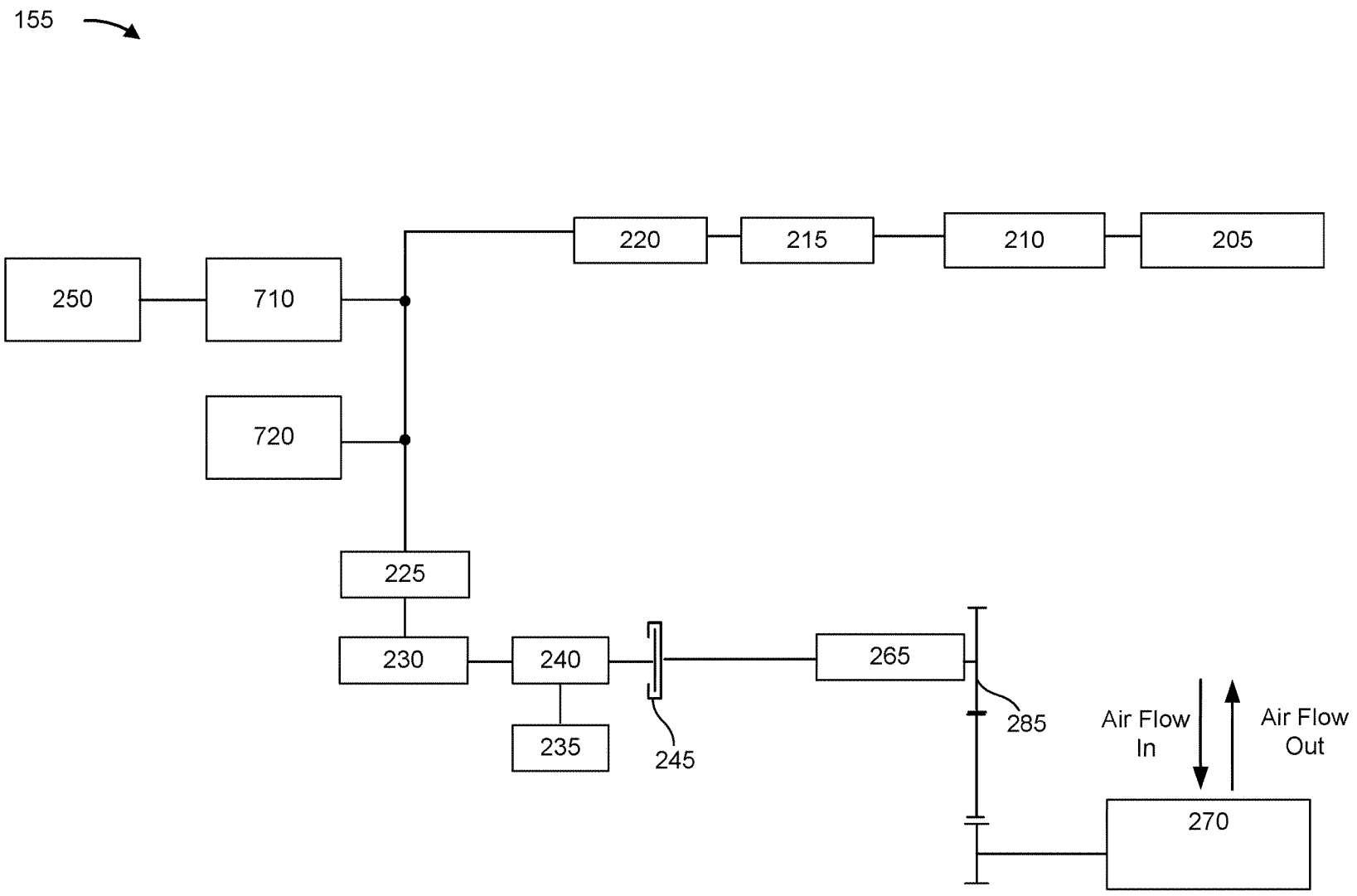

FIG. 7 is a diagram of an example power system 155 described herein. The elements of power system 155 have been described above with respect to FIG. 2. As shown in FIG. 7, battery 250 may be connected to the DC bus (connecting first inverter 220 and second inverter 225) via a DC/DC converter 710. Additionally, or alternatively, to battery 250 being connected to the DC bus, a battery 720 may be connected to the DC bus to provide supplemental power or replacement power, as described herein. As an example, battery 720 may be a 700-volt battery, although other types of batteries may be used in practice. In some implementations, the power system 155 described in FIG. 7 provides a common high-power electrical system supporting high-speed flywheel 205, battery 250, and battery 720. The power system 155 described in FIG. 7 eliminates complexity that may be associated with battery MGU 260 and retains superior high-speed flywheel 205 transient power dynamics. The power system 155 described in FIG. 7 provides an excellent alignment to existing off-road machines with 700V electric drive transmissions.

The number and arrangement of devices shown in FIG. 7 are provided as an example. In practice, there may be additional devices, fewer devices, different devices, or differently arranged devices than those shown in FIG. 7. Furthermore, two or more devices shown in FIG. 7 may be implemented within a single device, or a single device shown in FIG. 7 may be implemented as multiple, distributed devices. Additionally, or alternatively, a set of devices (e.g., one or more devices) of power system 155 may perform one or more functions described as being performed by another set of devices of power system 155.

Figure 8:
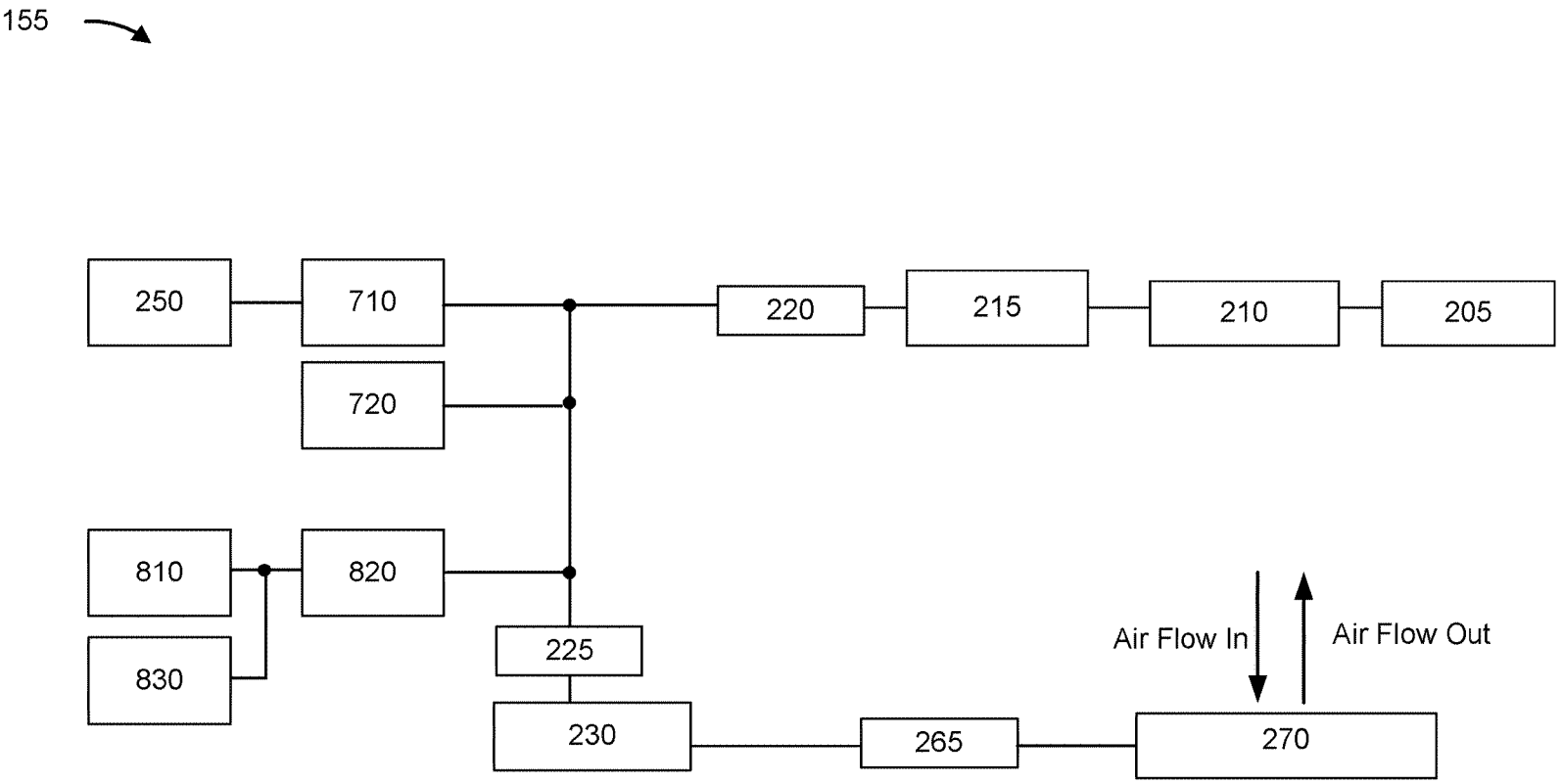

FIG. 8 is a diagram of an example power system 155 described herein. The elements of power system 155 have been described above with respect to FIGS. 2 and 7. As shown in FIG. 8, a load 810 may be connected to the DC bus (connecting first inverter 220 and second inverter 225) via a DC/DC converter 820. Additionally, or alternatively, to load 810 being connected to the DC bus via DC/DC converter 820, a battery 830 may be connected to the DC bus via DC/DC converter 820. In some instances, battery 830 may provide supplemental power or replacement power, as described herein. Load 810 may be an electrical load, on power system 155, to power machine 100 and/or to power implements of machine 100. As an example, battery 830 may be a 24-volt battery, although other types of batteries may be used in practice.

The number and arrangement of devices shown in FIG. 8 are provided as an example. In practice, there may be additional devices, fewer devices, different devices, or differently arranged devices than those shown in FIG. 8. Furthermore, two or more devices shown in FIG. 8 may be implemented within a single device, or a single device shown in FIG. 8 may be implemented as multiple, distributed devices. Additionally, or alternatively, a set of devices (e.g., one or more devices) of power system 155 may perform one or more functions described as being performed by another set of devices of power system 155.

Figure 9:
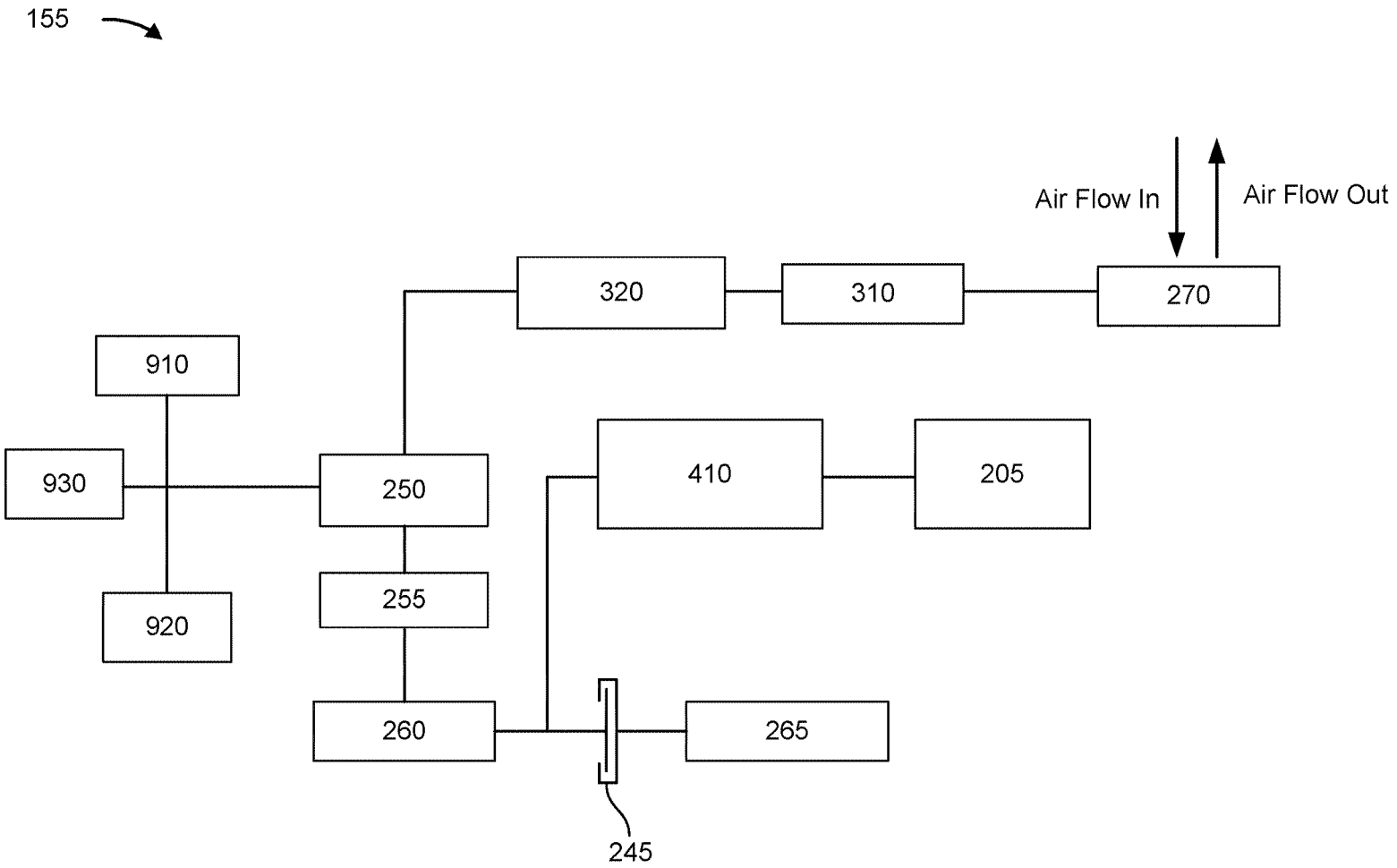

FIG. 9 is a diagram of an example power system 155 described herein. The elements of power system 155 have been described above with respect to FIGS. 2, 3, 4, and 5. As shown in FIG. 9, battery 250 and/or third inverter 255 may be connected to electric devices such an electric A/C unit 910, an electric water pump 920, and/or an electric fan 930. Electric A/C unit 910 may be configured for cooling operator cabin 120. Electric water pump 920 and/or electric fan 930 may configured for maintaining a temperature of engine 265. The power system 155 described in FIG. 9 provides a removal of a traditional FEAD for reduced engine design complexity and increased modularity. The power system 155 described in FIG. 9 also provides decreased fuel consumption by increased refinement/optimization of an operation of electrical A/C unit 910, electric water pump 920, and/or electric fan 930. The operating temperatures can be optimized to help reduce system friction and unnecessary cooling work.

The number and arrangement of devices shown in FIG. 9 are provided as an example. In practice, there may be additional devices, fewer devices, different devices, or differently arranged devices than those shown in FIG. 9. Furthermore, two or more devices shown in FIG. 9 may be implemented within a single device, or a single device shown in FIG. 9 may be implemented as multiple, distributed devices. Additionally, or alternatively, a set of devices (e.g., one or more devices) of power system 155 may perform one or more functions described as being performed by another set of devices of power system 155.

Figure 10:
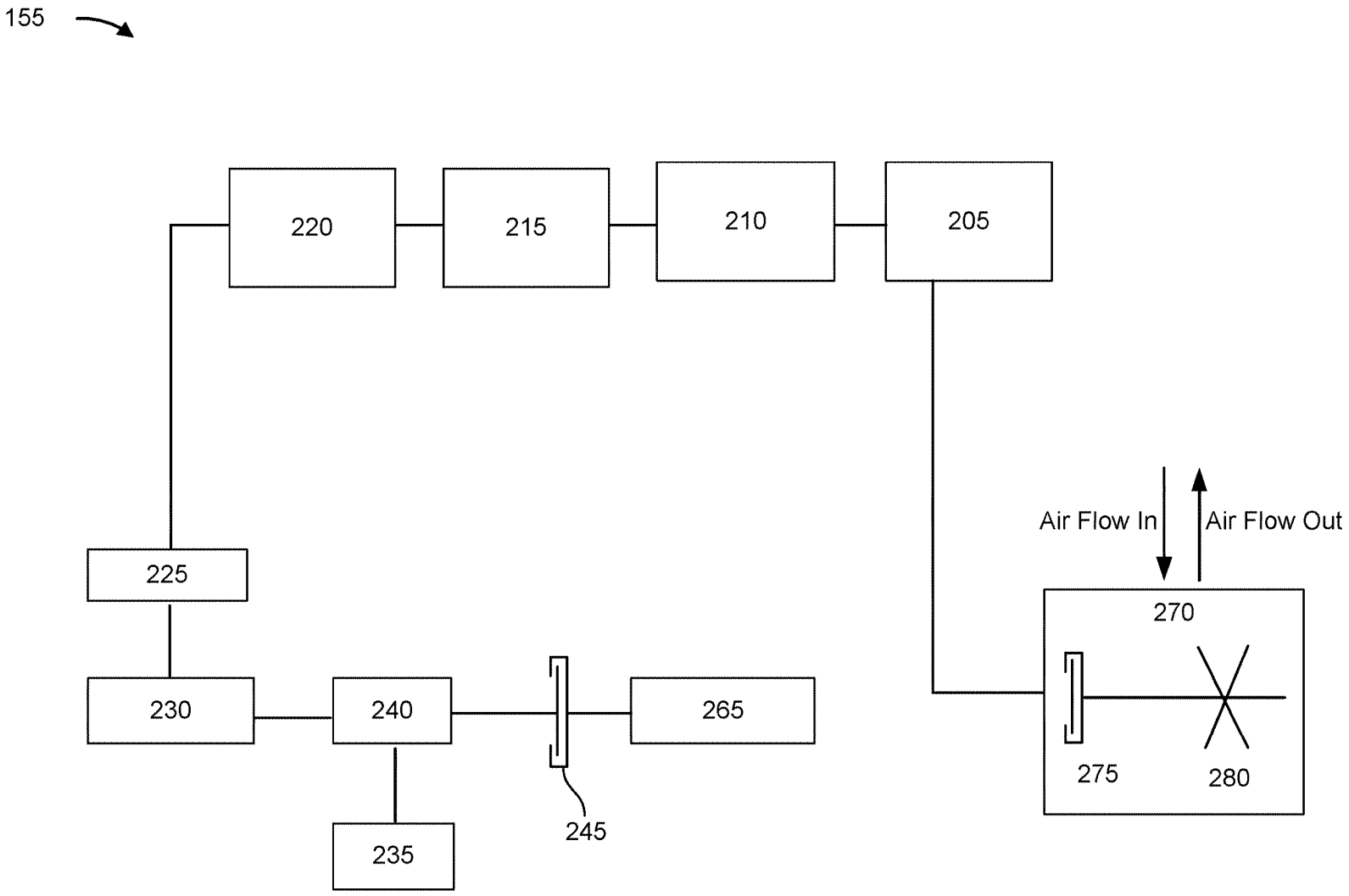

FIG. 10 is a diagram of an example power system 155 described herein. The elements of power system 155 have been described above with respect to FIG. 2. As shown in FIG. 10, high-speed flywheel 205 may be connected to gear ratio device 210 and gear ratio device 210 may be connected to flywheel MGU 215. Flywheel MGU 215 may be connected to first inverter 220 and first inverter 220 may be connected to second inverter 225. Second inverter 225 may be connected to engine MGU 230 and engine MGU 230 may be connected to FEAD 240. As shown in FIG. 10, turbocharger 270 may be connected to high-speed flywheel 205 via clutch 275 and CVT 280. In some instances, the electric drive (formed by flywheel MGU 215, first inverter 220, second inverter 225, and engine MGU 230) may be replaced by clutch and CVT 410. A speed ratio between high-speed flywheel 205 and turbocharger 270 may be managed by CVT 280 of turbocharger 270.

The number and arrangement of devices shown in FIG. 10 are provided as an example. In practice, there may be additional devices, fewer devices, different devices, or differently arranged devices than those shown in FIG. 10. Furthermore, two or more devices shown in FIG. 10 may be implemented within a single device, or a single device shown in FIG. 10 may be implemented as multiple, distributed devices. Additionally, or alternatively, a set of devices (e.g., one or more devices) of power system 155 may perform one or more functions described as being performed by another set of devices of power system 155.

Figure 11:
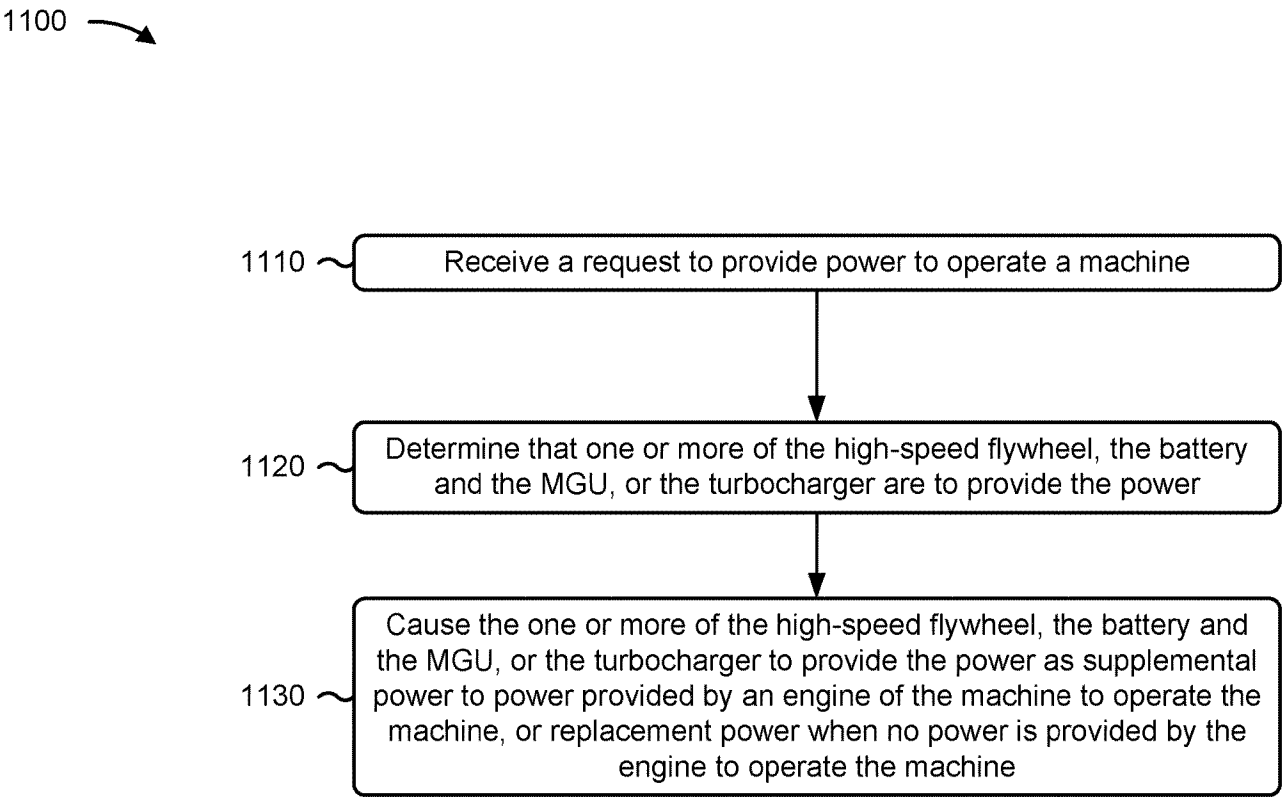
FIG. 11 is a flowchart of an example processes relating to providing power to a machine.

FIG. 11 is a flowchart of an example process 1100 associated with providing power to a machine. One or more process blocks of FIG. 11 may be performed by a controller (e.g., controller 145). One or more process blocks of FIG. 11 may be performed by another device or a group of devices separate from or including the controller, such as an engine (e.g., engine 265), a high-speed flywheel (e.g., high-speed flywheel 205), an MGU (e.g., battery MGU 260), and/or a turbocharger (e.g., turbocharger 270).

As shown in FIG. 11, process 1100 may include receiving a request to provide power to operate a machine, wherein the power system comprises a high-speed flywheel, a battery connected to an MGU, and a turbocharger (block 1110). For example, the controller may receive a request to provide power to operate a machine, as described above. In some implementations, the power system comprises a high-speed flywheel, a battery connected to an MGU, and a turbocharger.

Process 1100 further includes detecting an operation, of the machine, associated with a transient load of the machine, wherein receiving the request comprises receiving the request to provide the power as a response to the transient load, and wherein the supplemental power is provided as a response to the transient load.

Process 1100 further includes determining that the engine is shut down, wherein receiving the request comprises receiving a request to provide power to one or more components of the machine when the engine is shut down, and wherein, when causing the one or more of the high-speed flywheel, the battery and the MGU, or the turbocharger to provide the power, comprises causing one or more of the high-speed flywheel or the battery and the MGU to provide the replacement power to the one or more components when the engine shut down.

As further shown in FIG. 11, process 1100 may include determining, based on the request, that one or more of the high-speed flywheel, the battery and the MGU, or the turbocharger are to provide the power (block 1120). For example, the controller may determine, based on the request, that one or more of the high-speed flywheel, the battery and the MGU, or the turbocharger are to provide the power, as described above.

As further shown in FIG. 11, process 1100 may include causing the one or more of the high-speed flywheel, the battery and the MGU, or the turbocharger to provide the power as: supplemental power to power provided by an engine of the machine to operate the machine, or replacement power when no power is provided by the engine to operate the machine (block 1130). For example, the controller may cause the one or more of the high-speed flywheel, the battery and the MGU, or the turbocharger to provide the power as: supplemental power to power provided by an engine of the machine to operate the machine, or replacement power when no power is provided by the engine to operate the machine, as described above.

The MGU may be a first MGU, and process 1100 further includes detecting a braking operation of the engine, transmitting a signal to the first MGU, connected to the battery, to cause the battery to store a first portion of energy generated during the braking operation, and transmitting a signal to a second MGU, connected to the high-speed flywheel, to cause the high-speed flywheel to store a second portion of the energy generated during the braking operation, and wherein the supplemental power or the replacement power is provided based on at least one of the first portion of the energy stored by the battery, or the second portion of the energy stored by the high-speed flywheel.

Process 1100 further includes receiving a request to start the engine of the machine, and causing one or more of the high-speed flywheel or the battery and the MGU to provide power to start the engine.

Although FIG. 11 shows example blocks of process 1100, in some implementations, process 1100 may include additional blocks, fewer blocks, different blocks, or differently arranged blocks than those depicted in FIG. 11. Additionally, or alternatively, two or more of the blocks of process 1100 may be performed in parallel.

INDUSTRIAL APPLICABILITY

The present disclosure relates to a power system for off-road machines such as large wheel loaders, excavators, articulated trucks, among other examples. The power system includes a high-speed flywheel connected an engine, a battery, a motor-generator unit connected to the engine and the battery, and a turbocharger connected to the engine. The engine may be a reduced size engine (e.g., reduced with respect to full sized diesel engines currently used in off-road machines). The disclosed power system resolves issues associated with using a full sized diesel engine in an off-road machine and associated with using a smaller diesel engine in the off-road machine.

The issues include inadequate fuel efficiency and inadequate response to transient loads associated with an operation of the off-road machine. For example, the full sized diesel engine is not as efficient as it could be when sized for a transient response and durability requirements of a particular application. Accordingly, the full sized diesel engine may require frequent refueling of the off-road machine, which may decrease productivity of the off-road machine at a job site and increase ownership costs. The smaller diesel engine, on the other hand, is not capable of providing an adequate response to a transient load associated with an operation of the off-road machine, which may also decrease productivity of the off-road machine at a job site.

The power system, of the present disclosure, overcomes the issues mentioned above. For example, the engine may provide improved fuel efficiency (with respect to the full sized diesel engines) due to improved operating region efficiency. The power system may enable the engine to shut down when the machine is idle and may provide power to an air conditioning system and/or an electrical system of an operator cabin of the off-road machine when the engine is shut down (e.g., when the off-road machine is operating in a start/stop mode). The power system may provide supplemental power to power provided by the engine. Accordingly, the power system in conjunction with the engine may provide sufficient power, in a timely manner, as a response to a transient load of the machine.

The power system may provide energy recovery (e.g., as opposed to the full sized diesel engine which does not provide substantial energy recovery). The recovered energy may be used to directly supplement net system power of the off-road machine or to supplement power provided by the turbocharger in response to a transient load (e.g., in a transient load assist mode). Accordingly, the power system may provide improved fuel efficiency with respect to the full sized diesel engines, may enable the engine to provide power that is similar or substantially similar to power provided by the full sized diesel engines, may provide improved energy recovery with respect to the full sized diesel engines, among other examples.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus, device, and/or element may be otherwise oriented (rotated 90 degrees or at other orientations) and the spatially relative descriptors used herein may likewise be interpreted accordingly.

What is claimed is:

1. A power system, comprising:

a high-speed flywheel connected to an engine of a machine;

a battery;

a motor-generator unit (MGU) connected to the engine and the battery; and a turbocharger connected to the engine, wherein one or more of the high-speed flywheel, the battery and the MGU, or the turbocharger is configured to provide:

supplemental power to power provided by the engine to operate the machine, or replacement power when no power is provided by the engine to operate the machine, and wherein one or more of:

the power system further comprises a flywheel MGU, or the high-speed flywheel requires at least 20,000 revolutions per minute (RPM).

2. The power system of claim 1, wherein the high-speed flywheel is connected to a hybrid front-end accessory drive (FEAD) of the engine; and wherein the MGU is connected to the FEAD of the engine.

3. The power system of claim 1, wherein the MGU is a battery MGU;

wherein the engine is connected to an engine MGU; and wherein the high-speed flywheel is connected to the flywheel MGU.

4. The power system of claim 1, wherein the MGU is a first MGU that is connected to a first inverter;

wherein the engine is connected to a second MGU that is connected to a second inverter;

wherein the flywheel MGU is connected to a third inverter; and wherein the second inverter is connected to the third inverter.

5. The power system of claim 1, wherein the high-speed flywheel is connected to a gear ratio device; and wherein the gear ratio device is connected to the flywheel MGU.

6. The power system of claim 1, wherein the turbocharger is connected to a gear train of the engine; or wherein the turbocharger is connected to the engine via another MGU.

7. The power system of claim 1, further comprising a controller configured to:

receive a request to provide the supplemental power or the replacement power;

determine that the one or more of the high-speed flywheel, the battery and the MGU, or the turbocharger are to provide the supplemental power or the replacement power; and cause, based on the request, the one or more of the high-speed flywheel, the battery and the MGU, or the turbocharger to provide the supplemental power or the replacement power.

8. The power system of claim 1, further comprising a controller configured to:

determine that the engine is shut down;

receive a request to provide power to one or more components of the machine when the engine is shut down; and cause, based on the request, one or more of the high-speed flywheel or the battery and the MGU to provide the replacement power to the one or more components of the machine.

9. A work machine, comprising:

an engine;

a high-speed flywheel configured to recover or store at least a portion of energy generated during a braking operation of the engine, wherein the high-speed flywheel requires at least 20,000 revolutions per minute (RPM);

a battery;

a motor-generator unit (MGU) connected to the engine and the battery;

a flywheel MGU; and a turbocharger connected to the engine, wherein one or more of the high-speed flywheel, the battery and the MGU, or the turbocharger is configured to provide:

supplemental power to power provided by the engine to operate the work machine, or replacement power when no power is provided by the engine to operate the work machine.

10. The work machine of claim 9, wherein the turbocharger is configured to recover energy, from the engine, via turbo-compounding; and wherein the supplemental power is provided based on a portion of the energy recovered by the turbocharger.

11. The work machine of claim 9, wherein the high-speed flywheel is configured to store the portion of the energy generated during the braking operation of the engine;

wherein the battery is configured to store a different portion of the energy generated during the braking operation of the engine; and wherein the replacement power is provided based on at least one of:

the portion of the energy stored by the high-speed flywheel, or the different portion of the energy stored by the battery.

12. The work machine of claim 9, wherein the high-speed flywheel is connected to a hybrid front-end accessory drive (FEAD) of the engine; and wherein the MGU is connected to the FEAR of the engine.

13. The work machine of claim 12, wherein the high-speed flywheel is connected to the FEAD via the flywheel MGU and a first inverter; and wherein the battery is connected to the MGU via a second inverter.

14. The work machine of claim 9, further comprising a controller configured to:

detect an operation, of the work machine, associated with a transient load of the work machine;

receive a request to provide the supplemental power as a response to the transient load; and cause the one or more of the high-speed flywheel, the battery and the MGU, or the turbocharger to provide the supplemental power as the response to the transient load.

15. The work machine of claim 9, wherein one or more of the high-speed flywheel or the battery and the MGU is configured to provide the replacement power to operate one or more components of the work machine;

wherein the work machine is an off-road machine; and wherein the engine is a diesel engine.

16. A method, comprising:

receiving, by a controller of a power system, a request to provide power to operate a machine, wherein the power system comprises a high-speed flywheel, a battery, a flywheel motor-generator unit (MGU), and a turbocharger, and wherein a first rotational speed range of the flywheel MGU is less than a second rotational speed range of the high-speed flywheel;

determining, by the controller and based on the request, that one or more of the high-speed flywheel, the battery and the flywheel MGU, or the turbocharger are to provide the power; and causing, by the controller, the one or more of the high-speed flywheel, the battery and the flywheel MGU, or the turbocharger to provide the power as:

supplemental power to power provided by an engine of the machine to operate the machine, or replacement power when no power is provided by the engine to operate the machine.

17. The method of claim 16, further comprising:

detecting an operation, of the machine, associated with a transient load of the machine, wherein the supplemental power is provided as a response to the transient load.

18. The method of claim 16, wherein the flywheel MGU is a first flywheel MGU;

wherein the method further comprises:

detecting a braking operation of the engine;

transmitting a signal to the first flywheel MGU, connected to the battery, to cause the battery to store a first portion of energy generated during the braking operation; and transmitting a signal to a second flywheel MGU, connected to the high-speed flywheel, to cause the high-speed flywheel to store a second portion of the energy generated during the braking operation; and wherein the supplemental power or the replacement power is provided based on at least one of:

the first portion of the energy stored by the battery, or the second portion of the energy stored by the high-speed flywheel.

19. The method of claim 16, further comprising:

determining that the engine is shut down, wherein receiving the request comprises:

receiving the request when the engine is shut down; and wherein, when causing the one or more of the high-speed flywheel, the battery and the flywheel MGU, or the turbocharger to provide the power, comprises:

causing, based on the request, one or more of the high-speed flywheel or the battery and the flywheel MGU to provide the replacement power.

20. The method of claim 16, further comprising:

receiving a different request to start the engine of the machine; and causing one or more of the high-speed flywheel or the battery and the flywheel MGU to provide power to start the engine.

* * * * *